US007617568B2

(12) United States Patent
Jing

(10) Patent No.: US 7,617,568 B2
(45) Date of Patent: Nov. 17, 2009

(54) KNUCKLE ARM

(75) Inventor: Mao-Sheng Jing, Shen Zhen (CN)

(73) Assignee: Asia Optical Co., Inc., Taichung (TW)

( * ) Notice: Subject to any disclaimer, the term of this patent is extended or adjusted under 35 U.S.C. 154(b) by 565 days.

(21) Appl. No.: 11/486,153

(22) Filed: Jul. 14, 2006

(65) Prior Publication Data

US 2007/0067955 A1 Mar. 29, 2007

(30) Foreign Application Priority Data

Sep. 16, 2005 (TW) ..... 94132086 A

(51) Int. Cl.
*E05F 1/08* (2006.01)

(52) U.S. Cl. ..... 16/286; 16/239

(58) Field of Classification Search ..... 16/239, 16/237, 236, 287, 286, 289, 290, 292, 302, 16/303, 366, 368, 369; 361/680–683; 455/575.1, 455/575.3, 575.4, 575.8, 550.1, 90.3; 355/75; 358/497, 498; 399/377, 379, 380
See application file for complete search history.

(56) References Cited

U.S. PATENT DOCUMENTS 4,585,329 A * 4/1986 Landa ..... 399/113
4,853,750 A * 8/1989 Murata et al. ..... 355/75
6,593,999 B1 * 7/2003 Hosaka ..... 355/75
6,629,336 B2 * 10/2003 Hosaka et al. ..... 16/327
7,012,675 B1 * 3/2006 Zhang et al. ..... 355/75
7,337,499 B2 * 3/2008 Zhang et al. ..... 16/357
7,406,747 B2 * 8/2008 Chol ..... 16/239
2005/0044664 A1 * 3/2005 Chang ..... 16/327
2007/0089271 A1 * 4/2007 Jo et al. ..... 16/286

FOREIGN PATENT DOCUMENTS

JP 2000314992 A * 11/2000
JP 2001317264 A * 11/2001
JP 2002370761 A * 12/2002
JP 2003129739 A * 5/2003
JP 2006017855 A * 1/2006

* cited by examiner

*Primary Examiner*—Chuck Y. Mah
(74) *Attorney, Agent, or Firm*—Banner & Witcoff, Ltd.

(57) ABSTRACT

A knuckle arm is connected to a machine body and a top cover of a machine, and includes a mounting seat, a connecting seat, a sliding seat, and a resilient member. The mounting seat includes a mounting block disposed fixedly on the machine body, and a pivot block extending integrally from the mounting block and having a cam edge. The connecting seat is connected pivotally to the pivot block of the mounting seat, and is attached to the top cover. The sliding seat is disposed slidably within the connecting seat, and has an integral projection. The resilient member is disposed between the mounting seat and the sliding seat, and biases the sliding seat to move toward the mounting seat so as to keep the projection of the sliding seat in contact with the cam edge of the mounting seat.

6 Claims, 10 Drawing Sheets

KNUCKLE ARM

CROSS-REFERENCE TO RELATED APPLICATION

This application claims priority of Taiwanese Application No. 094132086, filed on Sep. 16, 2005.

BACKGROUND OF THE INVENTION

1. Field of the Invention

This invention relates to a part of an office machine, and more particularly to a knuckle arm that interconnects a machine body and a top cover of an office machine.

2. Description of the Related Art

Two knuckle arms are typically disposed between a top cover and a machine body of an office machine, such as a copier, or scanner, for use in the opening and closing of the top cover relative to the machine body. Referring to FIG. 1, a conventional knuckle arm 10, which is disclosed in U.S. Pat. No. 6,456,365, is shown to include a mounting seat 11 fixed on a machine body 21 of an office machine 20, a connecting seat 12 disposed pivotally on the mounting seat 11, a bottom cam sliding seat 13 disposed slidably within the connecting seat 12, a top cam sliding seat 14 disposed slidably within the connecting seat 12 and located above the bottom cam sliding seat 13, a compression spring 15 disposed between the bottom and top cam sliding seats 13, 14, a lifting seat 16 disposed pivotally on the connecting seat 12 and connected fixedly to a top cover 22 of the office machine 20, a bottom pivot rod 17 extending through the mounting seat 11 and the connecting seat 12 and kept in contact with a cam edge 131 of the bottom cam sliding seat 13, and a top pivot rod 18 extending through the connecting seat 12 and kept in contact with a cam edge 141 of the top cam sliding seat 14.

As such, a force can be applied to the top cover 22 so as to open and close the top cover 22 relative to the machine body 21. Although the knuckle arm 10 can achieve its intended purposes, in actual use, it suffers from the following disadvantages:

(1) The knuckle arm 10 has a substantial number of components, and therefore is bulky.

(2) There is a need for high precision during manufacture of the cam edges 131, 141 of the bottom and top cam sliding seats 13, 14. The processes required to achieve such high precision, particularly in consideration of the fact that the shapes of the cam edges 131, 141 are different, ultimately result in high manufacturing and design costs of the knuckle arm 10.

(3) During assembly, it is necessary to press the compression spring 15 toward the bottom sliding seat 13 just before the top pivot rod 18 is inserted into the connecting seat 12 and the lifting seat 16. The compression spring 15 has a large spring force that is difficult to overcome.

SUMMARY OF THE INVENTION

An object of this invention is to provide a knuckle arm that has a small number of components and a simple design so as to reduce the manufacturing costs thereof.

Another object of this invention is to provide a knuckle arm that is convenient to assemble.

Accordingly, a knuckle arm is connected to a machine body and a top cover of a machine, and includes a mounting seat, a connecting seat, a sliding seat, and a resilient member. The mounting seat includes a mounting block disposed fixedly on the machine body, and a pivot block extending integrally from the mounting block and having a cam edge. The connecting seat is connected pivotally to the pivot block of the mounting seat, and is attached to the top cover. The sliding seat is disposed slidably within the connecting seat, and has an integral projection.

The resilient member is disposed between the mounting seat and the sliding seat, and biases the sliding seat to move toward the mounting seat so as to keep the projection of the sliding seat in contact with the cam edge of the mounting seat.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
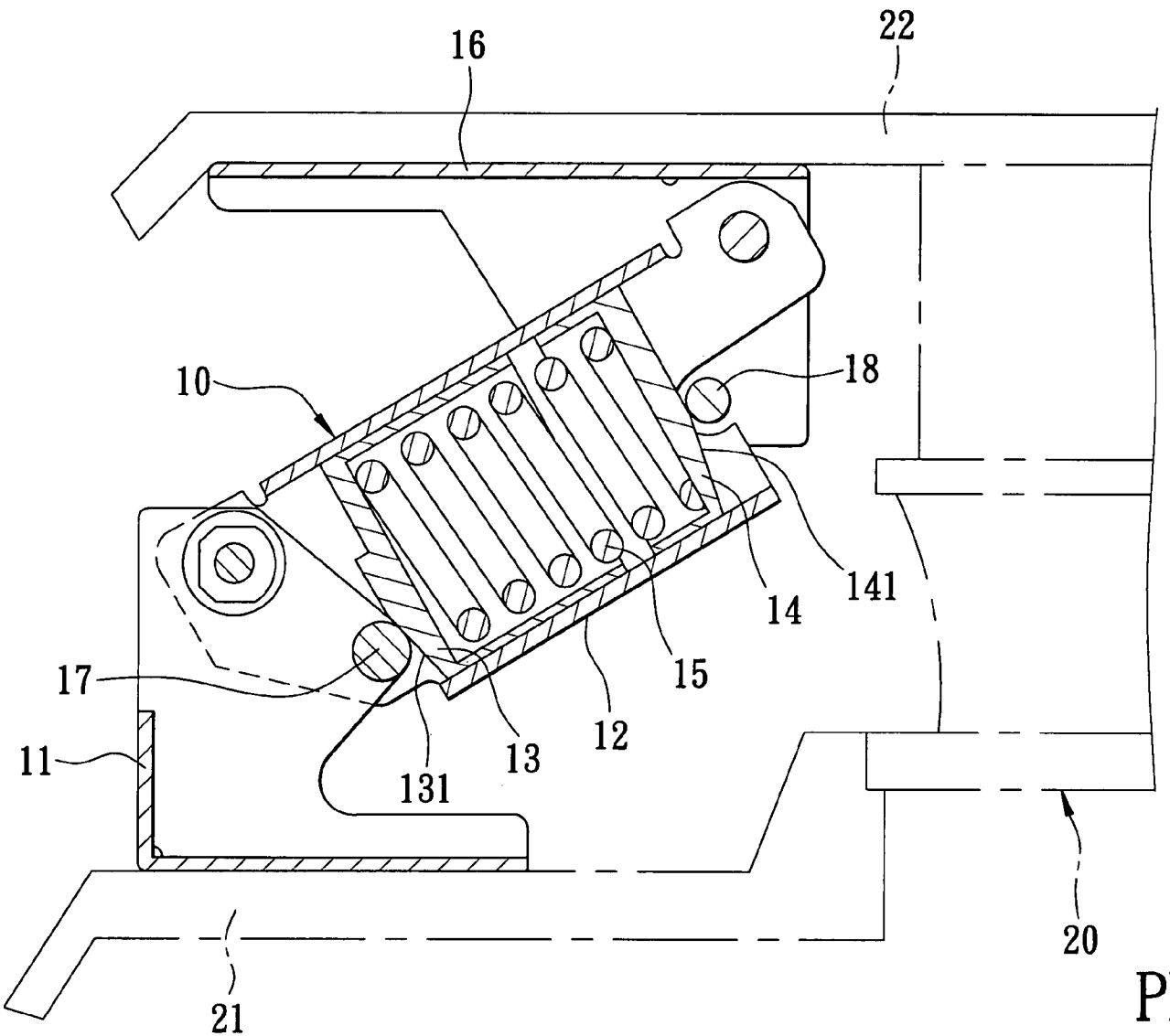
FIG. 1 PRIOR ART
FIG. 1 is a sectional view of a conventional knuckle arm disclosed in U.S. Pat. No. 6,456,365.
Figure 2:
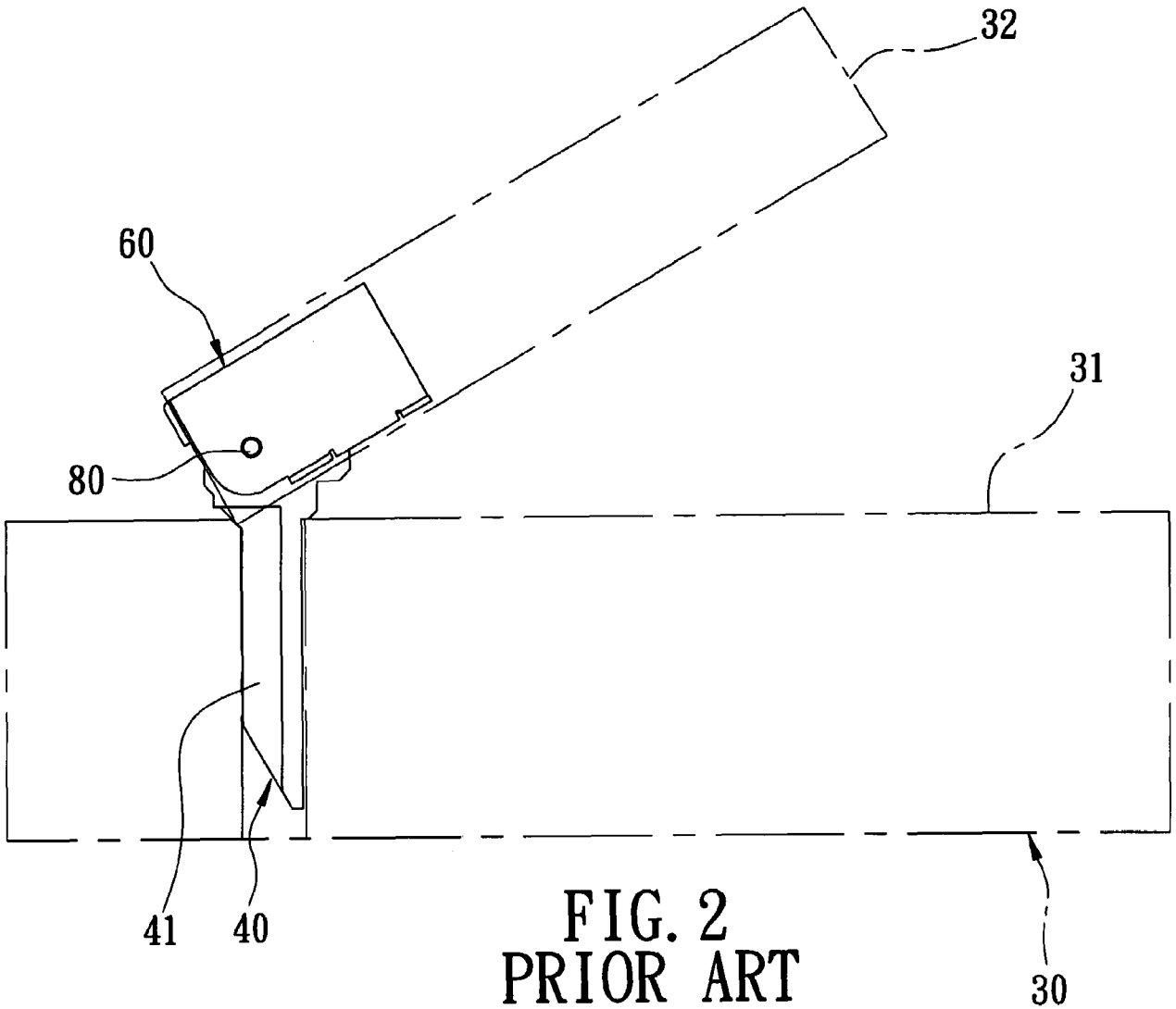
FIG. 2 PRIOR ART
FIG. 2 is a schematic view of an office machine mounted with the preferred embodiment of a knuckle arm according to this invention.

Referring to FIG. 2, the preferred embodiment of a knuckle arm according to this invention is disposed between a machine body 31 and a top cover 32 of an office machine 30, such as a copier, or a scanner. When the office machine 30 is a copier, the top cover 32 may serve as an auto document feeder.

Figure 3:
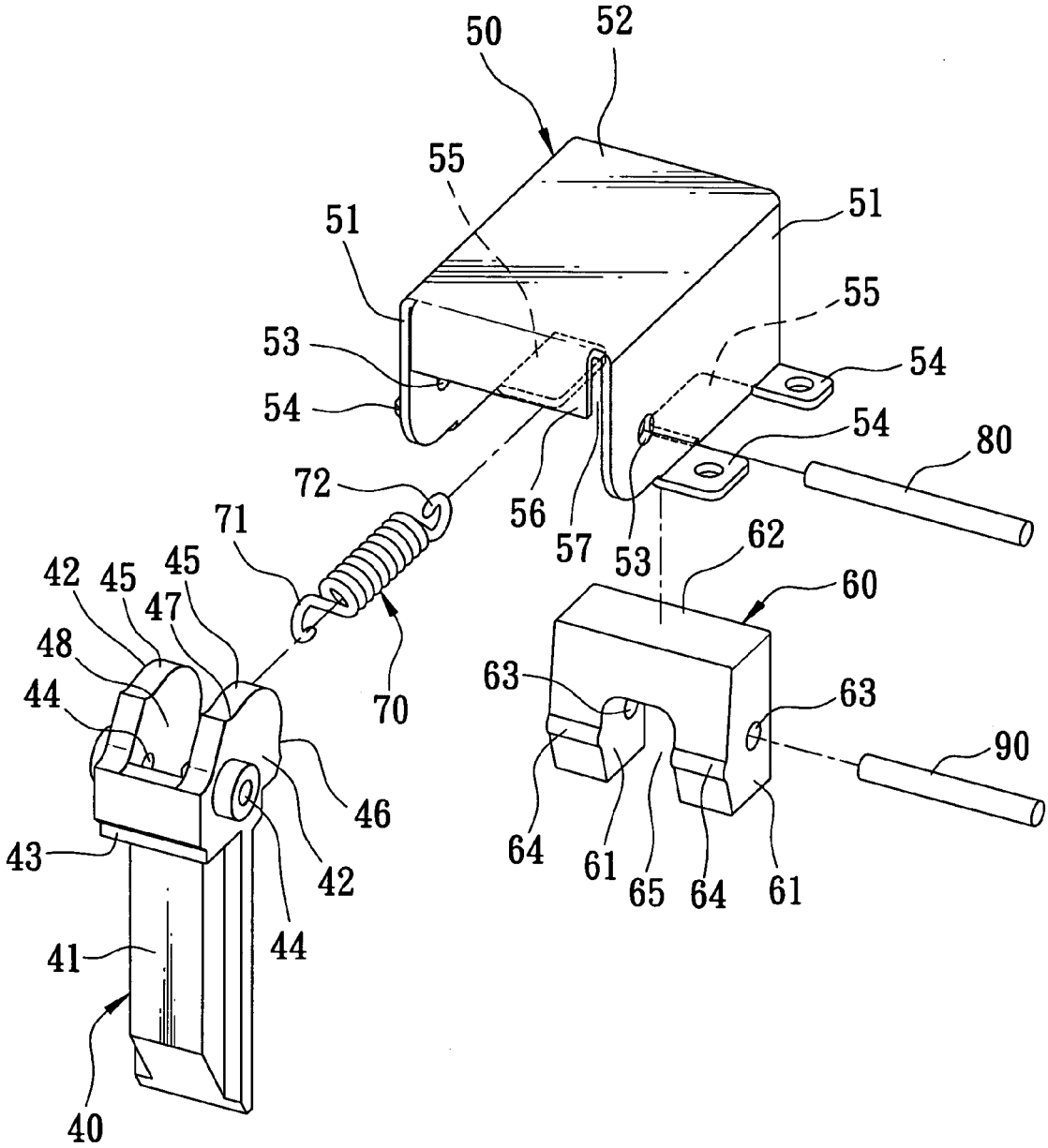
FIG. 3 is an exploded perspective view of the preferred embodiment.
Figure 4:
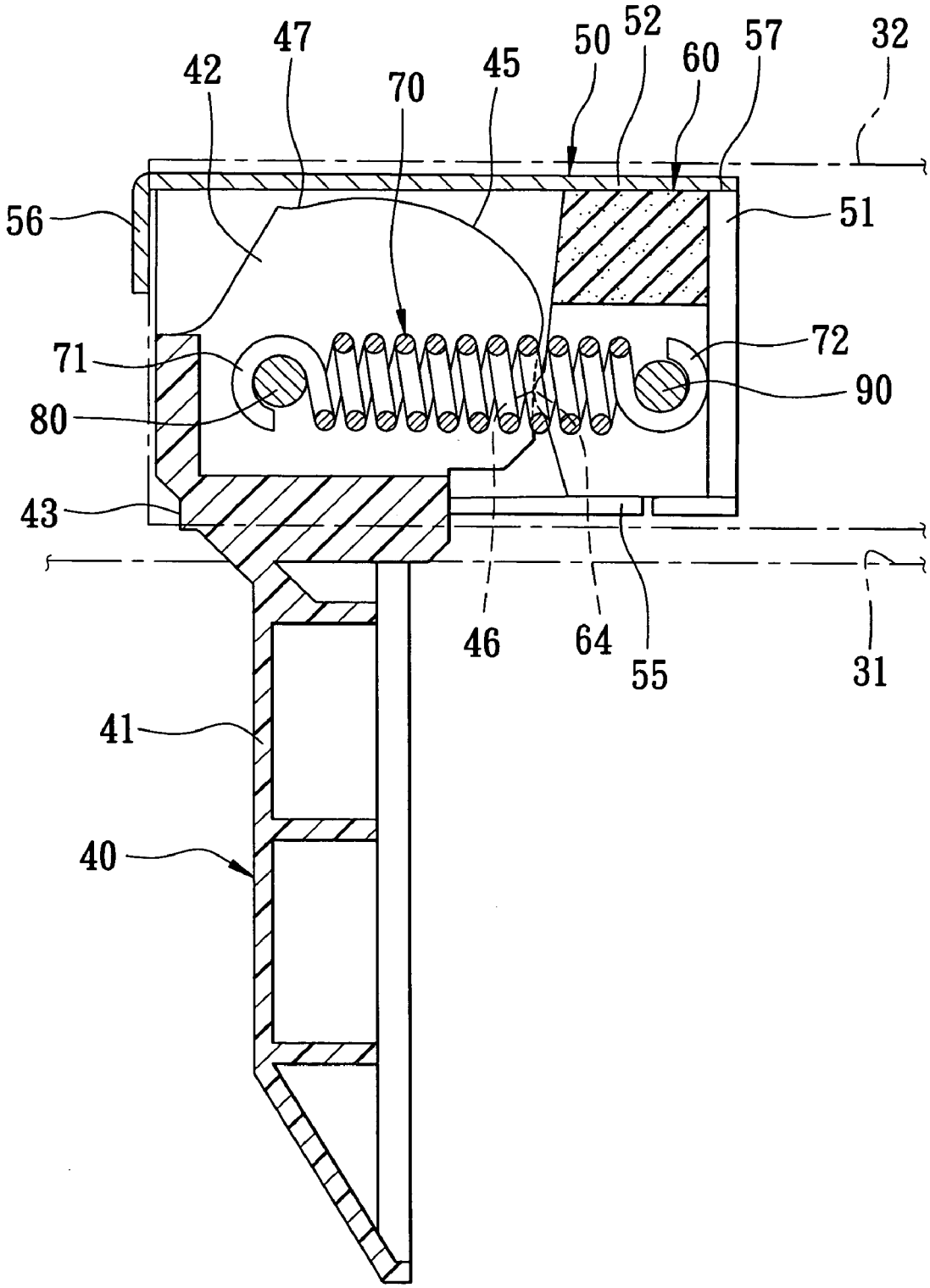
FIG. 4 is a sectional view of the preferred embodiment, illustrating how a top cover of the office machine is closed.

Referring to FIGS. 3 and 4, the knuckle arm includes a mounting seat 40, a connecting seat 50 connected pivotally to the mounting seat 40, a sliding seat 60 disposed movably within the connecting seat 50, and a resilient member 70 disposed between the mounting seat 40 and the sliding seat 60.

The mounting seat 40 is made of a plastic material, and includes a mounting block 41 disposed fixedly on the machine body 31, a pair of first and second pivot blocks 42 extending integrally from the mounting block 41 and spaced apart from each other by a mounting groove 48, and a positioning block 43 interconnecting the first and second pivot blocks 42. Each of the first and second pivot blocks 42 has a pivot hole 44. The first and second pivot blocks 42 have respectively curved first and second cam edges 45, each of which is formed with first and second positioning grooves 46, 47 disposed respectively at two opposite ends (i.e., lower and upper ends) thereof, as shown also in FIG. 9.

Figure 8:
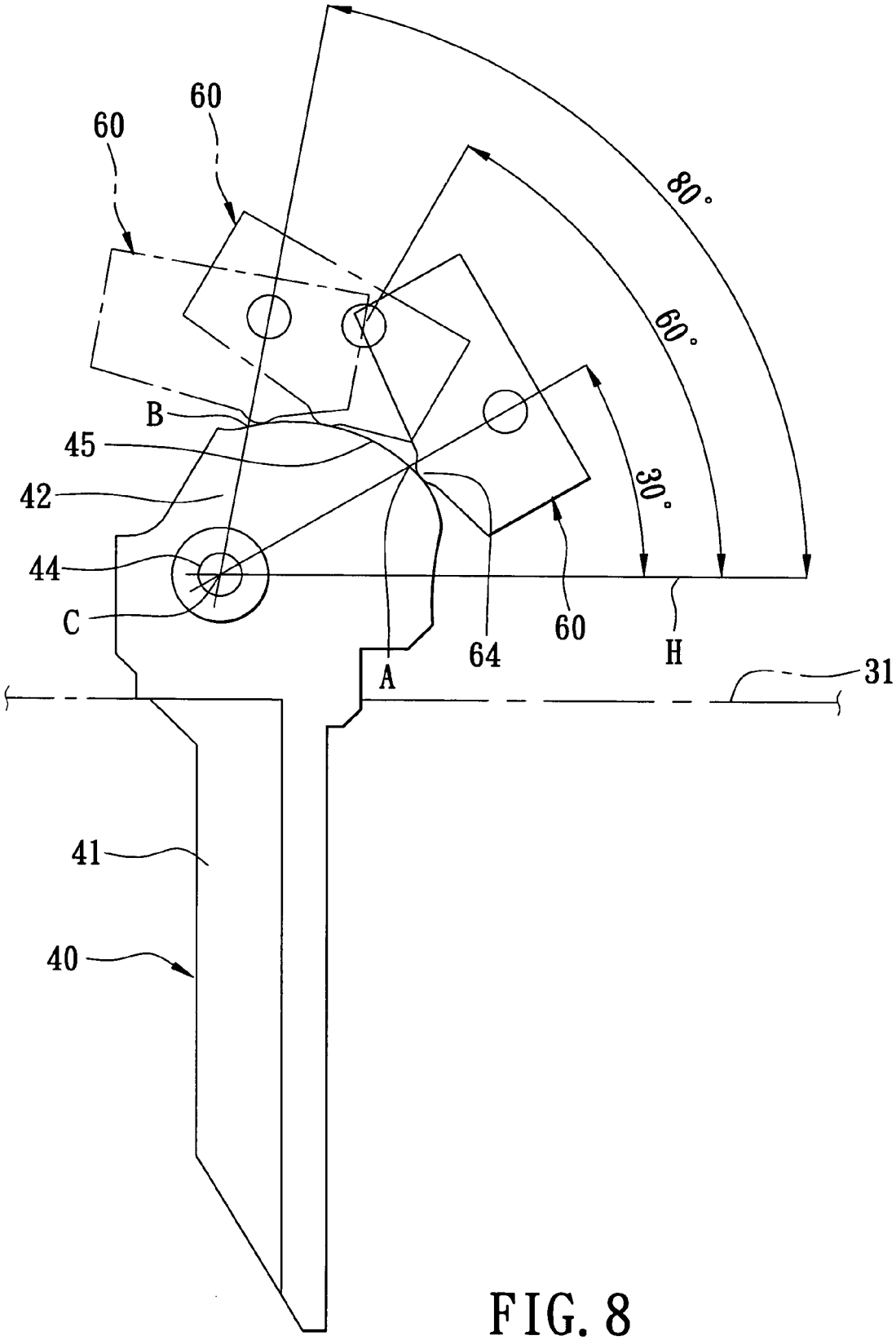
FIG. 8 is a schematic front view of the preferred embodiment, illustrating how a projection of a sliding seat is moved on a cam edge of a mounting seat.

With further reference to FIG. 8, each of the first and second cam edges 45 has an involute curve portion extending from a lower curve end point (A) to an upper curve end point (B) and spaced apart from the center (C) of the corresponding pivot hole 44 by a distance, which reduces gradually from the lower end point (A) to the upper end point (B). A line interconnecting the lower end point (A) and the center (C) forms an angle of 30° with a horizontal line (H). A line interconnecting the upper end point (B) and the center (C) forms an angle of 80° with the horizontal line (H).

Each of the first positioning grooves 46 in the first and second cam edges 45 is generally aligned with the corresponding pivot hole 44 along a horizontal direction. Further, each of the second positioning grooves 47 is generally aligned with the corresponding pivot hole 44 along a vertical direction.

The connecting seat 50 is attached to the top cover 32, and includes two vertical wing plates 51 located to two opposite sides of an assembly of the first and second pivot blocks 42 of the mounting seat 40, a horizontal coupling plate 52 interconnecting the wing plates 51 fixedly, two pivot holes 53 formed respectively through the wing plates 51, a plurality of horizontal locking plates 54 extending integrally and outwardly from lower ends of the wing plates 51, two support plates 55 extending respectively and integrally from the lower ends of the wing plates 51 toward each other, and a stop plate 56 extending integrally and downwardly from an end of the coupling plate 52. As such, an accommodating space 57 is defined among the coupling plate 52 and the support plates 55, and the wing plates 51.

The pivot rod 80 extends through the pivot holes 53 in the wing plates 51 and the pivot holes 44 in the first and second pivot blocks 42 of the mounting seat 40. This allows for pivoting movement of the connecting seat 50 relative to the mounting seat 40.

The sliding seat 60 is made of a plastic material, and is disposed movably within the accommodating space 57 in the connecting seat 50. However, the sliding seat 60 is disposed such that rotation of the sliding seat 60 in the accommodating space 57 is prevented. In this embodiment, the sliding seat 60 is inverted U-shaped, and includes a pair of first and second wing blocks 61 spaced apart from each other by a mounting groove 65, a coupling block 62 interconnecting the wing blocks 61 fixedly, two through holes 63 formed respectively through the wing blocks 61, and first and second projections 64 formed respectively on the first and second wing blocks 61 and contacting respectively the first and second cam edges 45.

The support rod 90 extends through the through holes 63 in the first and second wing blocks 61 of the sliding seat 60.

The resilient member 70 is configured as a coiled tension spring, and is disposed within the mounting grooves 48, 65 in the mounting block 40 and the sliding block 60. Two ends 71, 72 of the resilient member 70 are fastened respectively to the pivot rod 80 and the support rod 90. As such, the pivot rod 80 and the support rod 90 are biased toward each other by the resilient member 70 so as to keep the first and second projections 64 of the sliding seat 60 in contact with the first and second cam edges 45 of the mounting seat 40, respectively.

Figure 10:
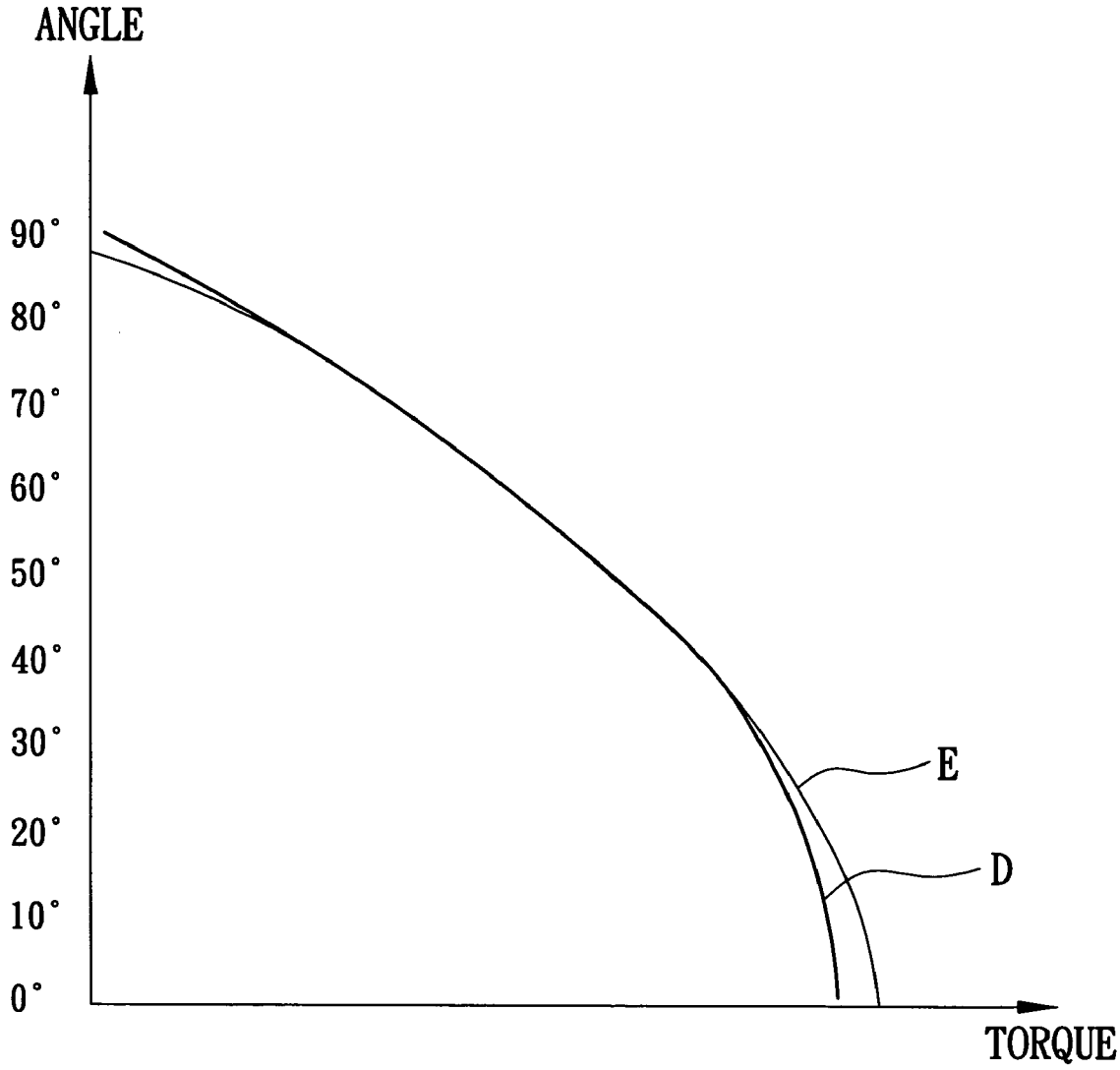
FIG. 10 is a graph showing the distribution of a spring torque and a gravitational torque as a function of an opening angle of the top cover.

With additional reference to FIG. 10, a spring force applied to the support rod 90 by the resilient member 70 is transmitted to the sliding seat 60, the connecting seat 50, and the top cover 32. As such, the resilient member 70 produces a counterclockwise spring torque (D) on the pivot rod 80, and the top cover 32 produces a clockwise gravitational torque (E) on the pivot rod 80. Each of the spring torque (D) and the gravitational torque (E) changes according to the positions of the connecting seat 50, the sliding seat 60, the resilient member 70, the pivot rod 80, and the support rod 90. FIG. 10 shows changes in the spring torque (D) and the gravitational torque (E) as a function of the opening angle of the top cover 32. When the spring torque (D) is equal to the gravitational torque (E), the top cover 32 is self-positioning.

Figure 9:
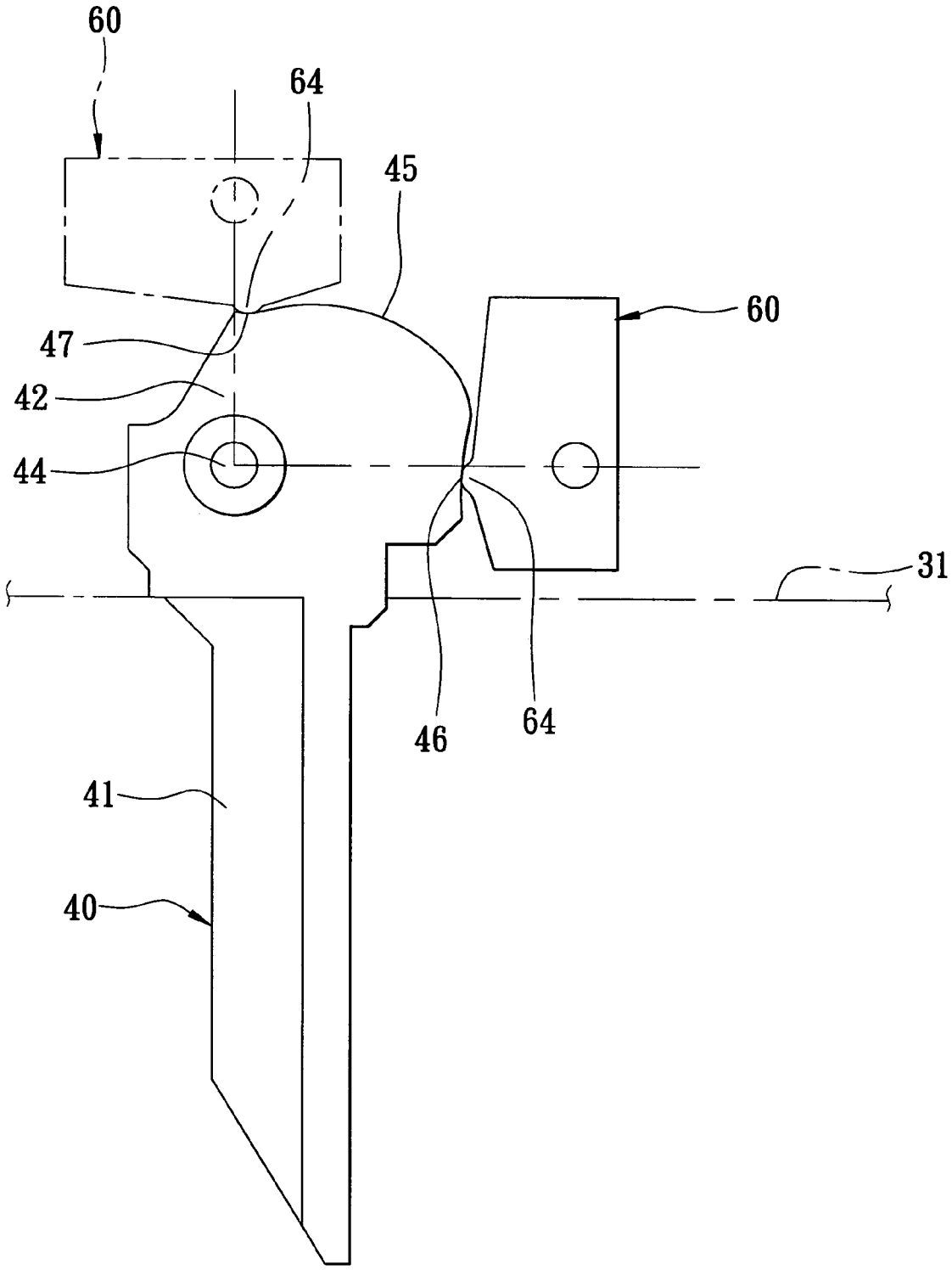
FIG. 9 is a schematic front view of the preferred embodiment, illustrating how the first and second projections of the sliding seat engage respectively first or second positioning grooves in the mounting seat.

As shown in FIGS. 4, 9, and 10, when the top cover 32 is closed (i.e. when the opening angle of the top cover 32 is zero), the gravitational torque (E) is greater than the spring torque (D), and the first and second projections 64 of the sliding seat 60 engage respectively the first positioning grooves 46 in the first and second cam edges 45 of the mounting seat 40. The resilient member 70 is stretched at this time so as to prevent pivoting movement of the top cover 31 relative to the machine body 31, thereby maintaining the top cover 32 at the closed position.

Figure 5:
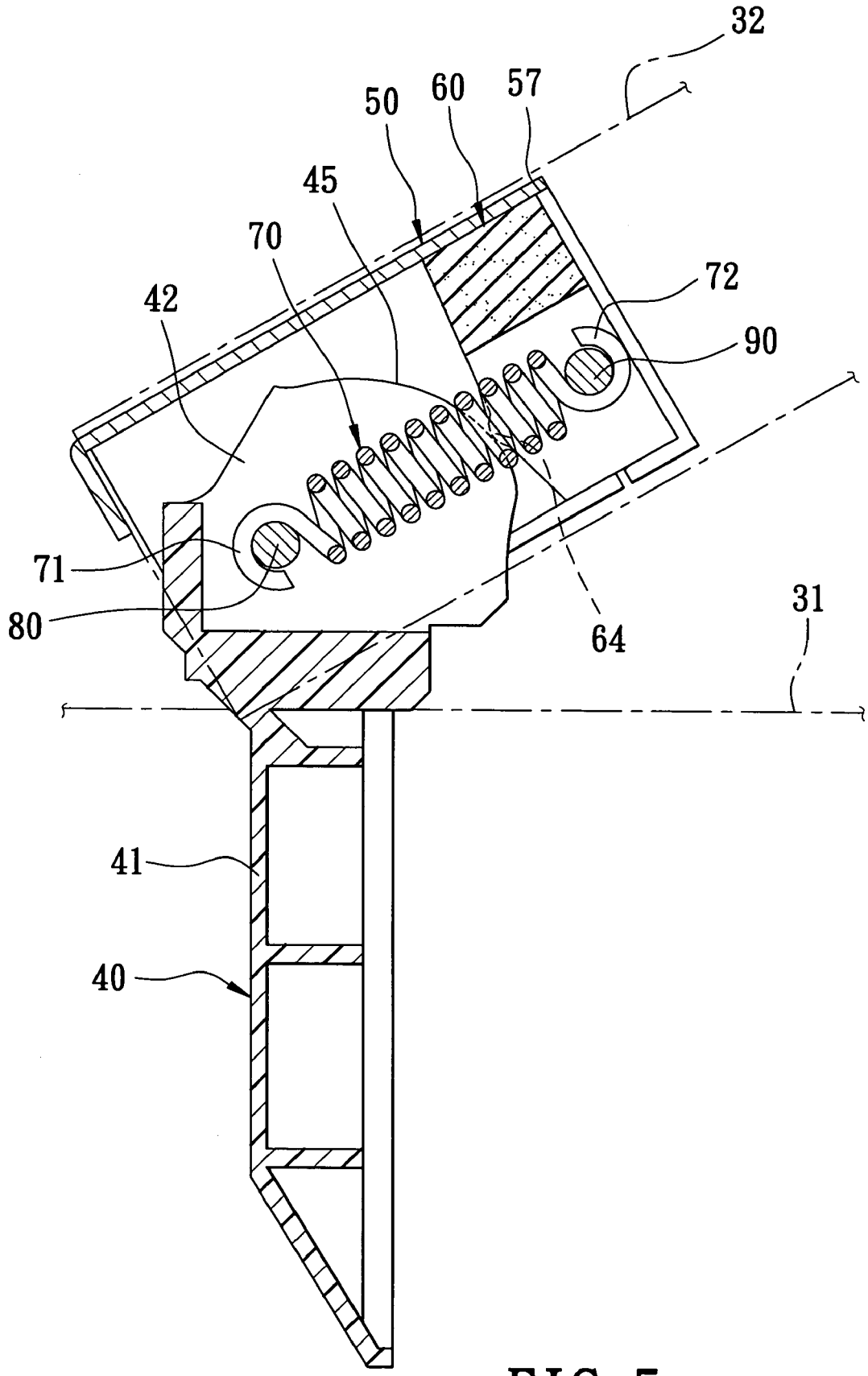
FIG. 5 is a sectional view of the preferred embodiment, illustrating how the top cover of the office machine is opened to an angle of about 30°.

As shown in FIGS. 5 and 10, the opening of the top cover 32 results in counterclockwise rotation of the connecting seat 50 about the pivot rod 80 and, thus, movement of the sliding seat 60 and the support rod 90 toward the mounting seat 40. When the top cover 32 is opened to an angle of about 30° or less and released, it returns to the closed position since the gravitational toque (E) is greater than the spring torque (D).

Figure 6:
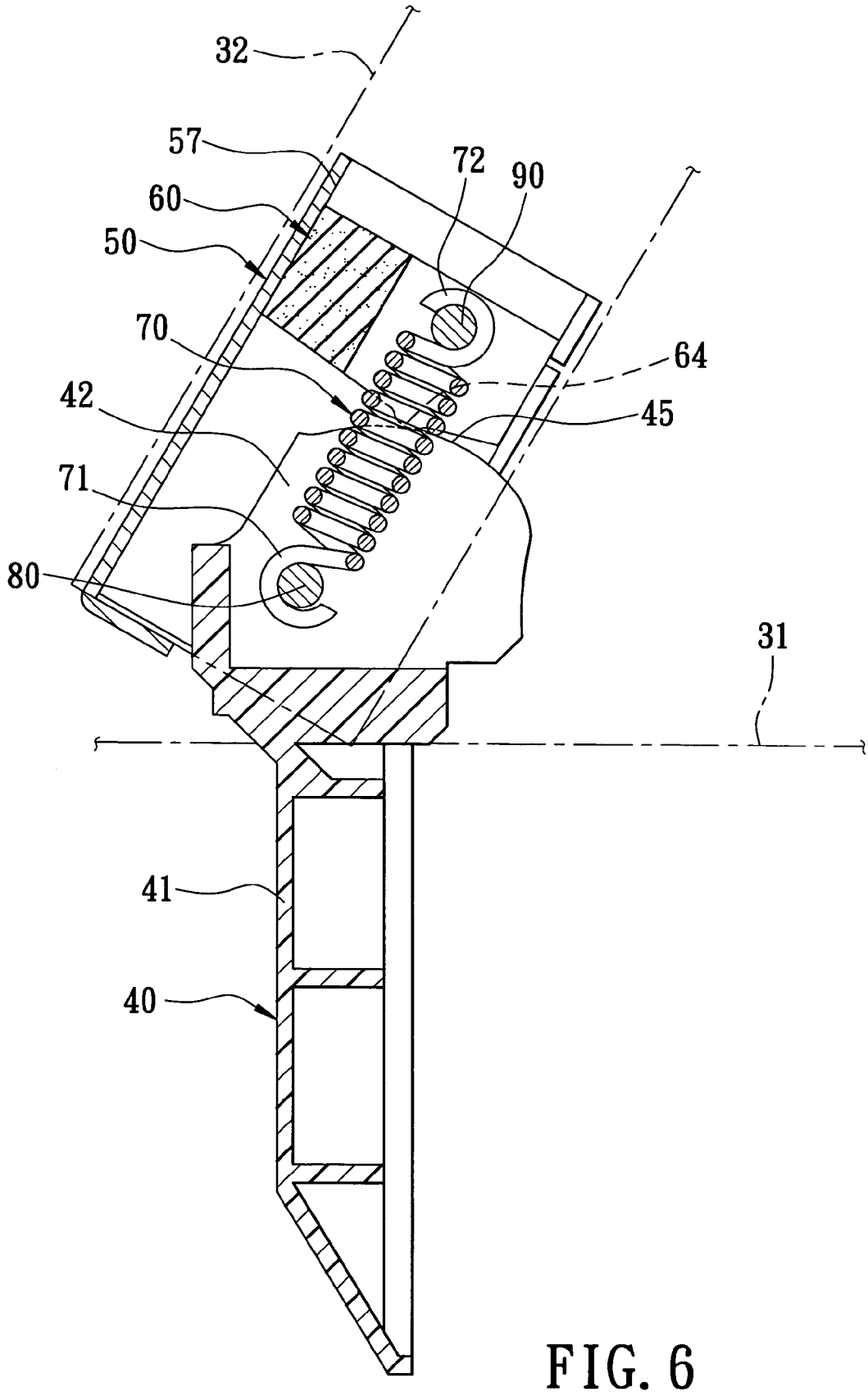
FIG. 6 is a sectional view of the preferred embodiment, illustrating how the top cover of the office machine is opened to an angle of about 60°.

As shown in FIGS. 6, 8, and 10, when the top cover 32 is opened to an angle between 30° and 80° and is released, it is maintained in situ since the gravitational torque (E) is equal to the spring torque (D).

Figure 7:
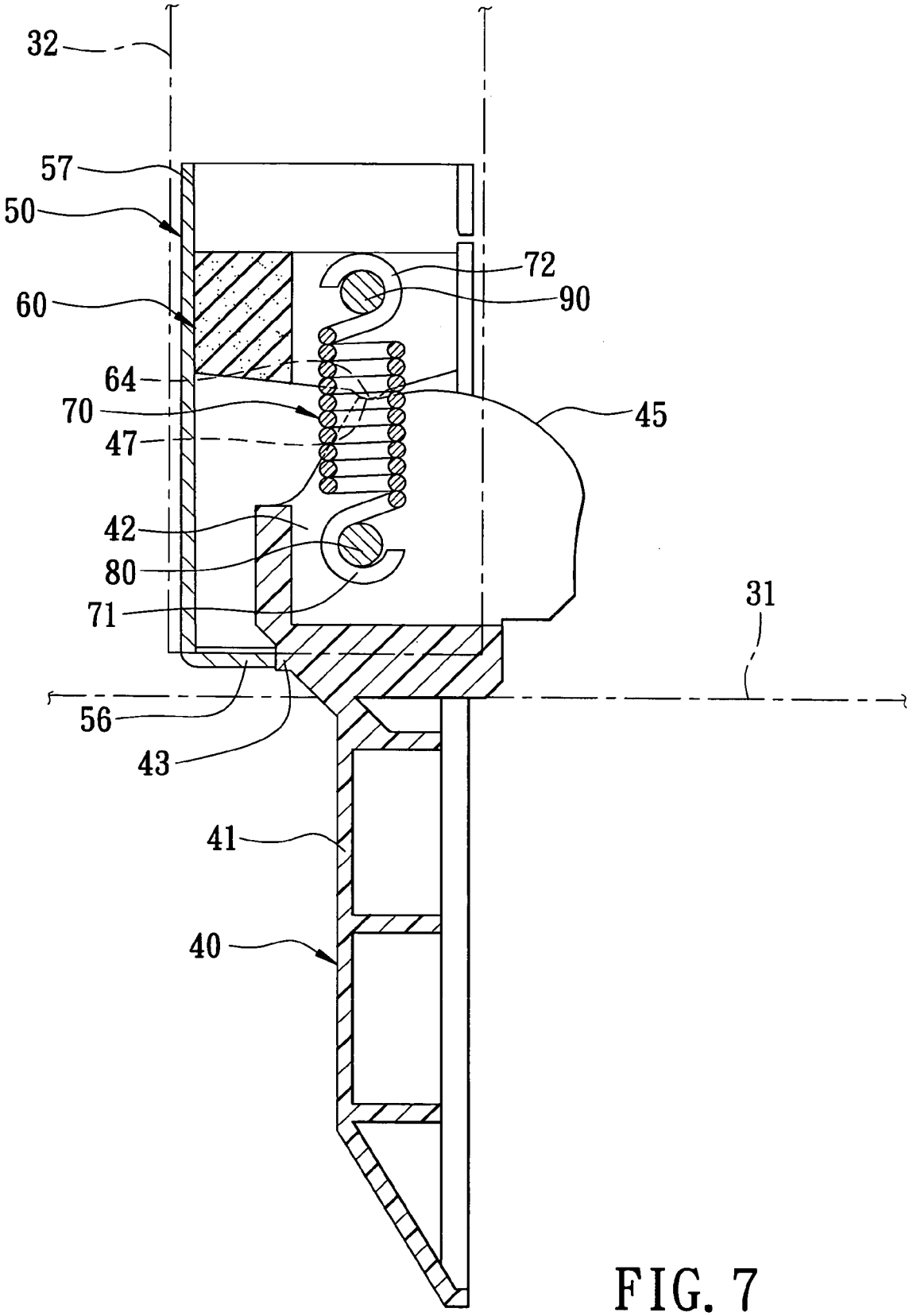
FIG. 7 is a sectional view of the preferred embodiment, illustrating how the top cover of the office machine is rotated to a 90° open position.

As shown in FIG. 10, when the top cover 32 is opened to an angle greater than 80° and is release, it rotates counterclockwise to a 90° open position shown in FIG. 7 whereat the top cover 32 is perpendicular to the machine body 31 since the gravitational torque (E) is smaller than the spring torque (D).

As shown by the phantom lines in FIGS. 7 and 9, when the top cover 32 is opened to the 90° open position, the first and second projections 64 engage respectively the second positioning grooves 47 in the first and second cam edges 45 of the mounting seat 40, and the stop plate 56 of the connecting seat 50 comes into contact with the positioning block 43 of the mounting seat 40, thereby preventing further counterclockwise rotation of the top cover 32 relative to the machine body 31. In the 90° open position, the length of the resilient member 70 is reduced to a minimum length, and the spring torque (D) is reduced to a minimum torque.

In view of the above, the knuckle arm of this invention has the following advantages:

(1) The knuckle arm has a small number of components. Thus, the manufacturing and design costs of the knuckle arm are reduced.

(2) The first and second cam edges 45 of the first and second pivot blocks 42 of the mounting seat 40 have the same shape, thereby resulting in low manufacturing and design costs of the knuckle arm.

(3) During assembly, when the top cover 32 is placed at the position shown in FIG. 7 relative to the machine body 31, since the distance between the pivot rod 80 and the support rod 90 is equal approximately to the minimum length of the resilient member 70, the ends 71, 72 of the resilient member 70 can be hooked respectively on the pivot rod 80 and the support rod 90 with ease.

It is noted that even if the second pivot block 42 and the second wing block 61 are omitted, which would result in omission also of the mounting grooves 48, 65, the second cam edge 45, and the second projection 64, the knuckle arm can still achieve the intended purposes and objects of this invention.

With this invention thus explained, it is apparent that numerous modifications and variations can be made without departing from the scope and spirit of this invention. It is therefore intended that this invention be limited only as indicated by the appended claims.

I claim:

1. A knuckle arm adapted to be connected to a machine body and a top cover of a machine, said knuckle arm comprising:

a mounting seat including a mounting block adapted to be disposed fixedly on the machine body, and a first pivot block extending integrally from said mounting block and having a first cam edge;

a connecting seat connected pivotally to said first pivot block of said mounting seat and adapted to be attached to the top cover;

a sliding seat disposed slidably within said connecting seat and having an integral first projection; and a resilient member disposed between said mounting seat and said sliding seat and biasing said sliding seat to move toward said mounting seat so as to keep said first projection of said sliding seat in contact with said first cam edge of said mounting seat;

wherein said mounting seat further includes a second pivot block extending integrally from said mounting block and having a second cam edge, and a mounting groove disposed between said first and second pivot blocks, said wing plates of said connecting seat being located respectively to two opposite sides of an assembly of said first and second pivot blocks of said mounting seat, said connecting seat being connected pivotally to said first and second pivot blocks of said mounting seat;

wherein said knuckle arm further comprises a pivot rod extending through said wing plates of said connecting seat and first and second pivot blocks of said mounting seat;

wherein said sliding seat includes a first wing block having said first projection, a second wing block having an integral second projection, a coupling block interconnecting said wing blocks fixedly, and mounting groove disposed between said first and second wing blocks.

2. The knuckle arm as claimed in claim 1, wherein said connecting seat includes two wing plates located respectively to two opposite sides of said first pivot block, a coupling plate interconnecting said wing plates fixedly, and two support plates extending respectively and integrally from said wing plates toward each other so as to define an accommodating space among said coupling plate, said support plates, and said wing plates, said sliding seat being disposed movably within said accommodating space in said connecting seat.

3. The knuckle arm as claimed in claim 1, further comprising a support rod extending through said first and second wing blocks, said resilient member being configured as a coiled tension spring disposed within said mounting grooves in said mounting seat and said sliding seat and having two ends fastened respectively to said pivot rod and said support rod.

4. The knuckle arm as claimed in claim 1, wherein said mounting seat further includes a positioning block interconnecting said first and second pivot blocks fixedly, said connecting seat further including an integral stop plate that comes into contact with said positioning block when the top cover is pivoted to a 90° open position whereat the top cover is perpendicular to the machine body, thereby preventing further rotation of the top cover relative to the machine body.

5. The knuckle arm as claimed in claim 1, wherein said first cam edge is formed with first and second positioning grooves disposed respectively at two opposite ends, said first positioning groove being situated such that said first projection of said sliding seat engages said first positioning groove when the opening angle of the top cover is zero, said second positioning groove being situated such that said first projection engages said second positioning groove when the top cover and the machine body form an angle of 90° therebetween.

6. The knuckle arm as claimed in claim 1, wherein said mounting seat further includes an integral positioning block, said connecting seat further including an integral stop plate that comes into contact with said positioning block when the top cover is pivoted to a 90° open position whereat the top cover is perpendicular to the machine body, thereby preventing further rotation of the top cover relative to the machine body.

* * * * *